US007598025B2

(12) United States Patent
Michiue et al.

(10) Patent No.: US 7,598,025 B2
(45) Date of Patent: Oct. 6, 2009

(54) HOLOGRAM SILVER HALIDE PHOTOGRAPHIC MATERIAL, HOLOGRAM AND METHOD FOR PRODUCING THE SAME

(75) Inventors: Kenji Michiue, Tokyo (JP); Tomonobu Moriya, Tokyo (JP); Masashi Iwasaki, Kyoto-Prefecture (JP); Toshihiro Kubota, Kyoto-Prefecture (JP); Masachika Watanabe, Tokyo (JP); Tsuyoshi Yamauchi, Tokyo (JP); Tomoko Kumasawa, Tokyo (JP); Kenji Ueda, Tokyo (JP)

(73) Assignees: Konica Minolta Opto Inc., Tokyo (JP); Dia Nippon Printing Co., Ltd., Tokyo (JP)

( * ) Notice: Subject to any disclaimer, the term of this patent is extended or adjusted under 35 U.S.C. 154(b) by 234 days.

(21) Appl. No.: 11/654,040

(22) Filed: Jan. 17, 2007

(65) Prior Publication Data

US 2007/0172779 A1 Jul. 26, 2007

(51) Int. Cl.

| | |
|---|---|
| ***G03C 7/00*** | (2006.01) |
| ***G03C 5/04*** | (2006.01) |
| ***G03C 1/005*** | (2006.01) |
| ***G03C 1/494*** | (2006.01) |

(52) U.S. Cl. ..... 430/363; 430/390; 430/494; 430/567; 430/570; 430/573

(58) Field of Classification Search ..... 430/494, 430/567, 363, 570, 573, 390
See application file for complete search history.

(56) References Cited

U.S. PATENT DOCUMENTS

| | | | | |
|---|---|---|---|---|
| 3,695,879 | A | 10/1972 | Laming et al. | |
| 4,720,441 | A | 1/1988 | Clark et al. | |
| 5,264,338 | A * | 11/1993 | Urabe et al. | 430/568 |

OTHER PUBLICATIONS

Journal of the Society of Photographic Science and Technology of Japan, pp. 51-52, Dec. 1, 2005.

* cited by examiner

*Primary Examiner*—Geraldina Visconti
(74) *Attorney, Agent, or Firm*—Roylance, Abrams, Berdo & Goodman, L.L.P.

(57) ABSTRACT

The present invention is characterized to provide a hologram silver halide photographic material having high sensitivity and diffraction efficiency, providing an excellent image and having less color residue and noise in a transparent part, a hologram, a method for producing the same.

In the present invention, a hologram silver halide photographic material having at least one silver halide emulsion layer formed on a support, wherein an average particle diameter of silver halide particles in a silver halide emulsion is 0.03 μm to 0.07 μm; a film thickness of the silver halide emulsion layer is 4 μm to 9 μm; a silver/gelatin ratio of the silver halide emulsion layer is 0.3 to 0.6; and the silver halide emulsion layer contains sensitizing dye of specific structure.

12 Claims, 6 Drawing Sheets

HOLOGRAM SILVER HALIDE PHOTOGRAPHIC MATERIAL, HOLOGRAM AND METHOD FOR PRODUCING THE SAME

BACKGROUND OF THE INVENTION

1. Field of the Invention

The present invention relates to a hologram silver halide photographic material having a silver halide emulsion layer, a hologram, and a method for producing the same. In particular, the present invention relates to a hologram silver halide photographic material having high sensitivity and diffraction efficiency, providing an excellent image and having less color residue and noise in a transparent part, a hologram, and a method for producing the same.

2. Description of the Background Art

The application range of a hologram has spread gradually for ornamental use or medical care in recent years. Among these, attention has focused on a phase type hologram having a bright image.

In the hologram, waves of light coming from an object are recorded on a photosensitive material in the form of an interference fringe with a reference wave, and the wave face of object light is reproduced as diffraction light from the hologram.

Examples of photosensitive materials having high resolution and sufficient sensitivity which can be used for this hologram include a silver halide photographic material (photosensitive material). In order to obtain a bright reproduction image by the hologram, the diffraction efficiency is required to be high. In order to enhance the diffraction efficiency, for example, the application silver amount of the silver halide photosensitive material is increased. However, when the coated silver amount is increased, the developing speed is reduced, and it takes time to obtain the image.

As a method for obtaining a clear image having a bright reproduction image, a method for using iodination potassium before bleaching (ref. U.S. Pat. No. 4,720,441), or a method for forming a cured film after developing processing (ref. U.S. Pat. No. 3,695,879) or the like have been known. However, these conventional techniques have not been sufficient, and further improvement has been required.

Red light sources such as a red semiconductor laser and a He—Ne laser are common as the least expensive and simplest light source in laser exposure of these holograms. The sensitizing dye for these light sources is deposited in a gelatin film after developing processing and washing, and most of the sensitizing dyes cause color residue or noise. In particular, this phenomenon appears notably when increasing the coated silver amount so as to obtain diffraction efficiency to some extent, and it is difficult to obtain good diffraction efficiency.

SUMMARY OF THE INVENTION

According to the above, it is an object of the present invention to provide a hologram silver halide photographic material having high sensitivity and diffraction efficiency, providing an excellent image and having less color residue and noise in a transparent part, a hologram, a method for producing the same.

The object of the present invention is attained by the following composition.

1. A hologram silver halide photographic material having at least one silver halide emulsion layer formed on a support, wherein an average particle diameter of silver halide particles in a silver halide emulsion is 0.03 μm to 0.07 μm; a film thickness of the silver halide emulsion layer is 4 μm to 9 μm; a silver/gelatin ratio of the silver halide emulsion layer is 0.3 to 0.6; and the silver halide emulsion layer contains at least one kind of compounds represented by the following general formula [D],

[Chemical Formula 1]

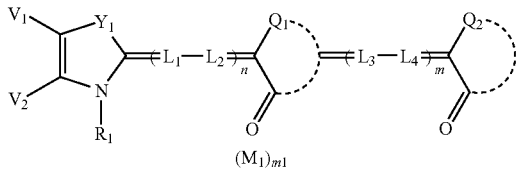

general formula [D]

wherein $Y_1$ represents a —N(R)— group, an oxygen atom, a sulfur atom, or a selenium atom; R represents an aliphatic group having carbon atoms of 10 or less. $R_1$ represents an aliphatic group, aryl group or heterocyclic group which contains at least one water-soluble group as a substituted group. $V_1$ and $V_2$ respectively represent a hydrogen atom, an alkyl group, an alkoxy group, an aryl group, or a substituted or non-substituted group forming a condensed ring with an azole ring by the bonding of $V_1$ and $V_2$. n represents 1 or 2 and m represents 0 or 1. $L_1$, $L_2$, $L_3$ and $L_4$ respectively represent a methine group; at least one of $L_1$ and $L_2$ has a substituted group of which the carbon atoms is 3 or more and SP is less than 539 when n is 1 or 2 and m is 0; and at least one of $L_1$, $L_2$, $L_3$ and $L_4$ has a substituted group of which the carbon atoms is 3 or more and SP is less than 539 when n is 1 or 2 and m is 1. Herein, SP is a value represented by SP=3.563L−2.661B+535.4; L represents a Sterimol parameter (Å); and B represents a value (Å) of the smaller one of the sum $B_1+B_4$ and sum $B_2+B_3$ of the Sterimol parameter. $Q_1$ and $Q_2$ respectively represent a nonmetallic atom group required for forming an acid ring. $M_1$ represents an ion required for cancelling all the electric charges of a molecule, and $n_1$ represents the number required for neutralizing the electric charges of the molecule. $n_1$ is 3 or more.

2. A hologram, wherein exposing, developing and bleaching are conducted using the hologram silver halide photographic material described in the above item 1.

3. The hologram described in the above item 2, of which the diffraction efficiency in exposing amounts of 100 $\mu Jcm^{-2}$ is 40% or more.

4. A method for producing a hologram, wherein the hologram silver halide photographic material described in the above item 1 is exposed, developed and bleached.

5. A method for producing a hologram, wherein the developing described in the above item 4 is conducted by ascorbic acid, sodium carbonate and a developer containing phenidone.

6. A hologram method for producing, wherein the bleaching described in the above item 4 is conducted by a bleach solution containing parabenzoquinone, citric acid and potassium bromide.

DETAILED DESCRIPTION OF THE INVENTION

Figure 1:
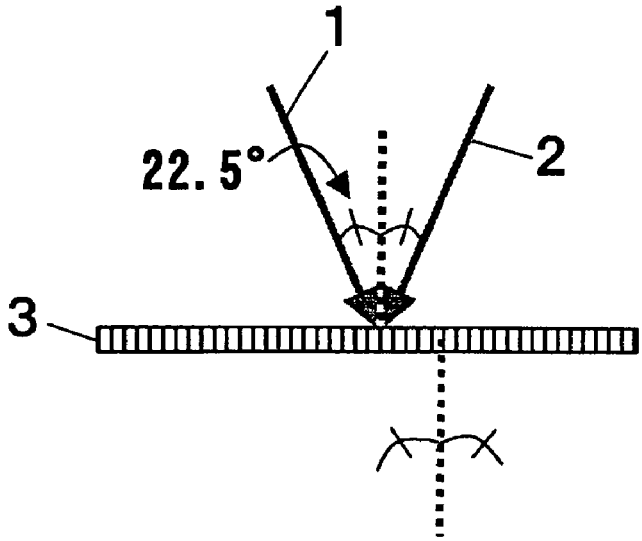
FIG. 1 is an explanatory drawing of recording method in the transmission type hologram.

Hereinafter, the present invention will be described in detail. First, a Sterimol parameter will be described. For example, as described in the Journal of Japanese Chemistry, extra number 122 "Structure activity relationship of drugs—Guidelines for drug design and study on mechanism of action," pp. 139 to 141, 1979 (Nankodo), or Verloop. A., Hoogenstraaten, W., Tipker, J.,: "Drug Design, Vol. VII" (Ariens, E. J., Ed.). Academic Press, New York (1976), pp. 180 to 185, the Sterimol parameter is one of the steric parameters widely used in the field of structure activity relationship of drugs. The Sterimol parameters L, $B_1$, $B_2$, $B_3$ and $B_4$ are defined as follows. L: Assume that all the substituted groups are attached to a benzene nucleus. An L axis is taken in a direction of a bond axis connecting the substituted group to the benzene nucleus. In consideration of the bond distance and vander Waals radius of each atom constituting the substituted group, the projection thereof to the L axes is considered. Of these, the longest value is set to L. $B_1$, $B_2$, $B_3$ and $B_4$: Project the form of the substituted group to a plane perpendicular to the L axis. In the projection, the width in four directions right-angled to each other starting from the pass point (bonding point) of the L axis is determined to be $B_1$, $B_2$, $B_3$ and $B_4$ in order of smaller width. That is, $B_1 \leqq B_2 \leqq B_3 \leqq B_4$. Such a Sterimol parameter has various advantages. Examples thereof include the following items (1) and (2). (1) Although the substituted group in which a steric-effect constant $E_s$ value is actually measured is limited, the Sterimol parameter can be calculated by calculation referring to any substituted groups. (2) Since the steric effect of the substituted group exerted on the drug effect can be divided into the effect of the width and length of the substituted group, the content of the steric effect can be more correctly recognized.

Specific preferable examples of the substituted groups having carbon atoms of 3 or more and being SP<539 include a substituted or non-substituted branch alkyl group having carbon atoms of 3 or more, a substituted or non-substituted benzyl group, a substituted or non-substituted phenethyl group, and a substituted or non-substituted alkoxy carbonyl group having carbon atoms of 4 or more. It is preferable that the substituted groups are non-substituted. Preferable examples include an isopropyl group, a branch butyl group, a branch pentyl group, a branch hexyl group, a branch octyl group, a benzyl group, a phenethyl group, t-butyloxy carbonyl group, a cyclopentyl group and a cyclo propyl group.

$Q_1$ and $Q_2$ respectively represent a nonmetallic atom group required for forming an acid ring. $M_1$ represents an ion required for cancelling all the electric charges of a molecule, and $n_1$ represents a number required for neutralizing the electric charges of the molecule, and $n_1$ is 3 or more. Specific examples of the rings having $Q_1$ and $Q_2$ are shown below.

[Chemical Formula 2]

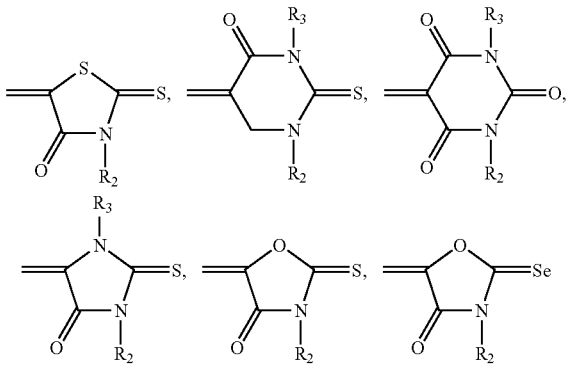

In the above chemical formula 2, $R_2$ and $R_3$ respectively represent a hydrogen atom, an alkyl group, an aromatic group, a hetero ring group, a carbonyl alkyl group, an alkylthio group, an amide group, an ureide group, a thioureide group and an oxyalkyl group or the like. These groups may be further substituted, and when and $R_2$ and $R_3$ exist, any one of $R_2$ and $R_3$ is In particular preferably substituted with a water-soluble group. Preferable examples of the water-soluble group are the same as ones described above.

Although a technique relating to a sensitizing dye defining the Sterimol parameter is described in Japanese Published Unexamined Patent Application No. 63-239436, this relates to sensitivity and preservability, and an effect of improvement of contamination on the pigment of the mother nucleus represented by the general formula (D) of the present invention has not been known at all.

Next, specific examples of compounds represented by the general formula (D) are shown.

[Chemical Formula 3]

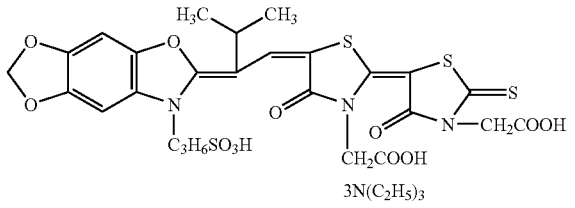

D-1

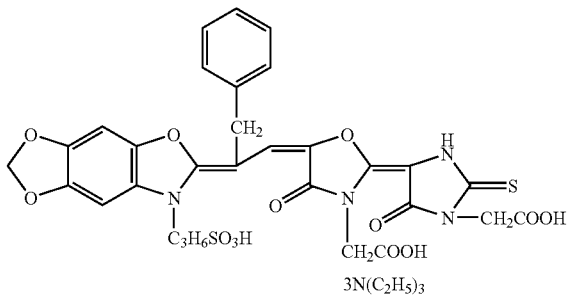

D-2

-continued
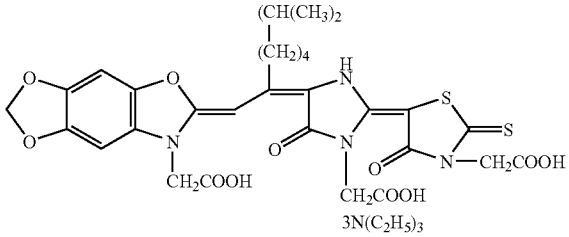
D-3
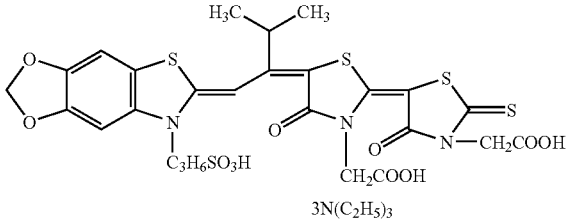
D-4
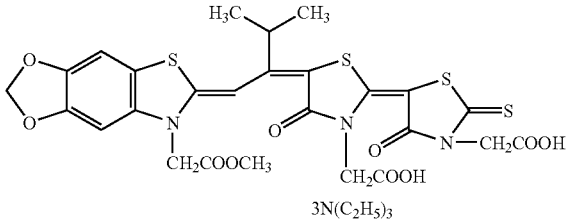
D-5
[Chemical Formula 4]
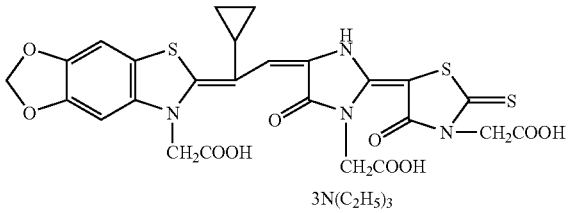
D-6
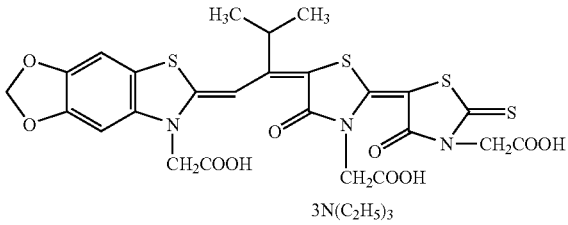
D-7
-continued
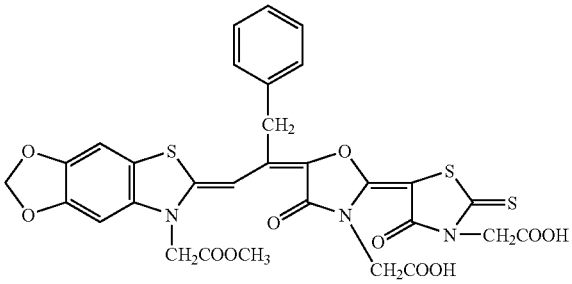
D-8
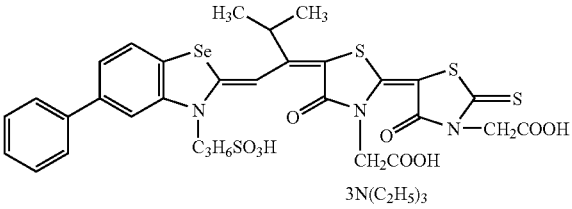
D-9
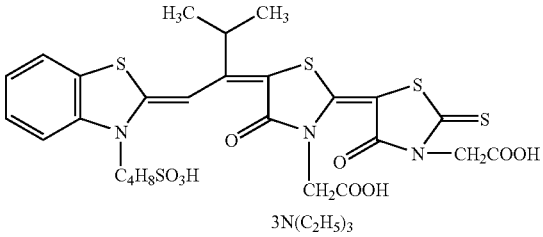
D-10
[Chemical Formula 5]
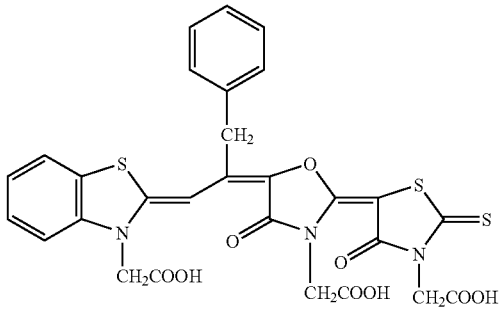
D-11
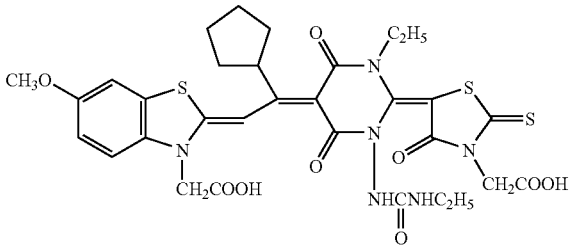
D-12

[Chemical Formula 6]
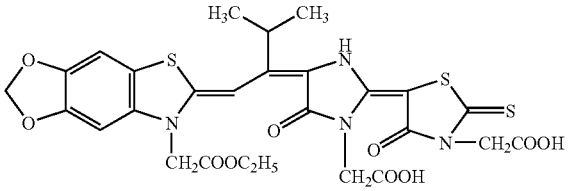
$3N(C_2H_5)_3$
D-13
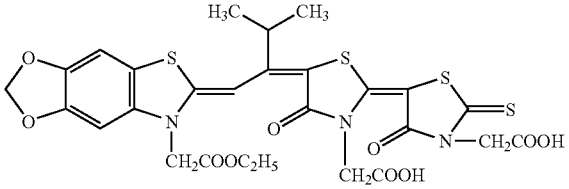
$3N(C_2H_5)_3$
D-14
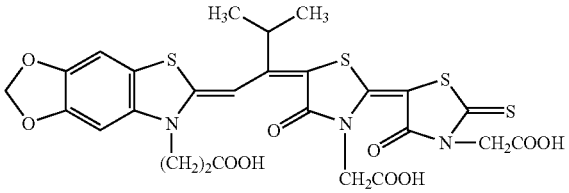
$3N(C_2H_5)_3$
D-15
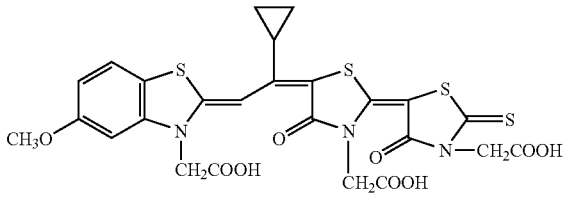
$3N(C_2H_5)_3$
D-16
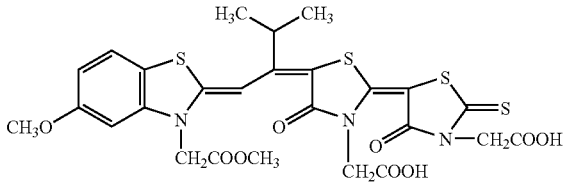
$3N(C_2H_5)_3$
D-17
[Chemical Formula 7]
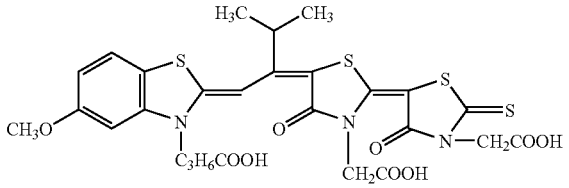
$3N(C_2H_5)_3$
D-18
-continued
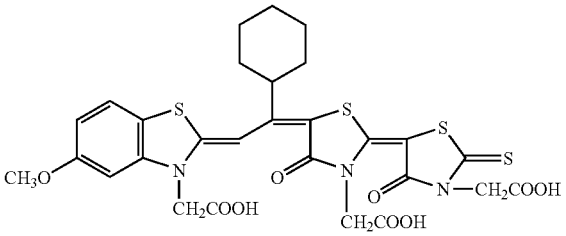
$3N(C_2H_5)_3$
D-19
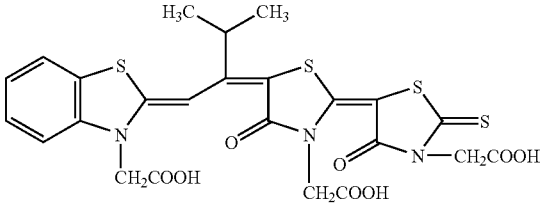
$3N(C_2H_5)_3$
D-20
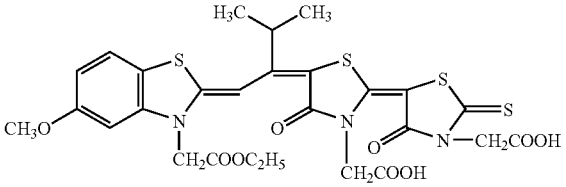
$3N(C_2H_5)_3$
D-21
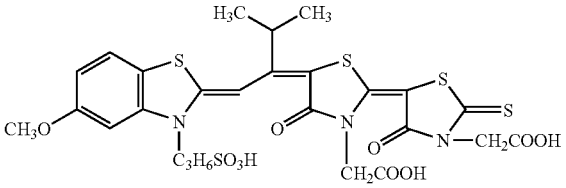
$3N(C_2H_5)_3$
D-22
[Chemical Formula 8]
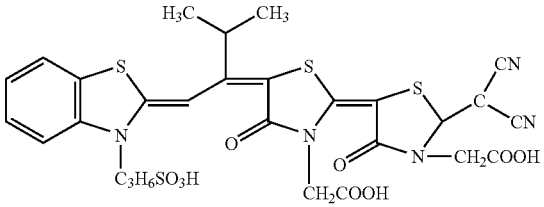
$3N(C_2H_5)_3$
D-23

-continued

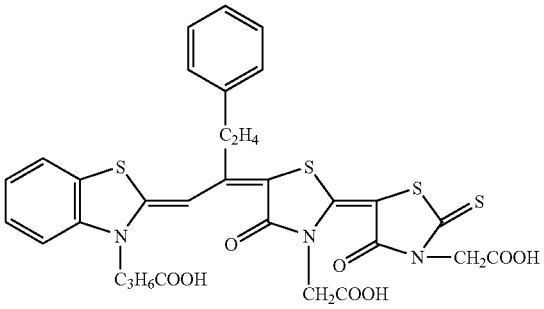

$3N(C_2H_5)_3$

D-24

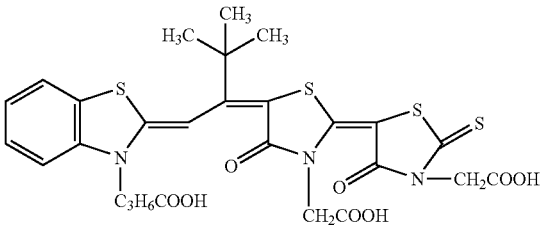

$3N(C_2H_5)_3$

D-25

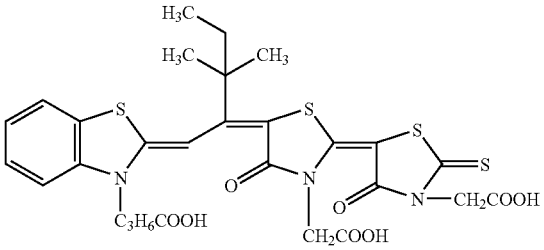

$3N(C_2H_5)_3$

D-26

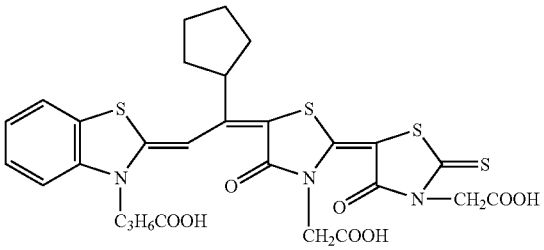

$3N(C_2H_5)_3$

D-27

In all of D-1 to D-27, n1 shown in the general formula (D) is 3. The compound represented by the general formula (D) can be synthesized by known synthesizing methods, and for example, reference can be made to Japan Unexamined Patent Publication No. 10-219125.

It is preferable that the silver halide emulsion layer is allowed to contain the compound represented by the general formula (D). The compound represented by the general formula (D) can be directly dispersed in the silver halide emulsion. The compound can be dissolved in a suitable solvent, for example, methyl alcohol, ethyl alcohol, methyl cellosolve, acetone, water, pyridine or these mixed solvents, and the resultant solution can also be added to the emulsion. As the method for adding the compound to the hydrophilic colloid layer coating liquid containing the emulsion, the known methods for adding a sensitizing dye can be applied.

The content of the compound represented by the general formula (D) is usually $1\times10^{-6}$ to $5\times10^{-3}$ mol per 1 mol of silver halide, and preferably $3\times10^{-6}$ to $2.5\times10^{-3}$ mol.

The average particle diameter of the silver halide particle of the silver halide emulsion of the present invention is 0.03 to 0.07 μm, and is preferably 0.02 to 0.06 μm. When the average particle diameter is less than 0.03 μm, the sensitivity may be remarkably deteriorated. When the average particle diameter exceeds 0.07 μm, the quality of the image may be deteriorated.

The particle diameter of the silver halide particles is measured by a scanning or transmission electron microscope observation. In the case of a hexahedron, the particle diameter is calculated as a length of one side of a square or is calculated as an arithmetic average value of the lengths of a long side and short side of a rectangle. In the case of a spherical object, the particle diameter is calculated as the length of the diameter of a sphericity (true globule) having the same volume. In the present invention, the average particle diameter of the silver halide particles means an average particle diameter calculated by arithmetically averaging the particle diameter of 30 pieces (preferably, 30 pieces or more) of the silver halide particles calculated by measuring as described above by the transmission electron microscope observation.

The film thickness of the silver halide emulsion layer means the film thickness after applying and drying the emulsion, and is measured in the condition of a temperature of 23° C. and relative humidity of 50%. As the measuring method, flaws are formed to glass on the emulsion film surface, and the depth from the film surface is measured using a machine such as the Taly step manufactured by Taylor Hobson. The film thickness of the emulsion layer is 4 μm to 9 μm, and preferably 6 μm to 9 μm. When the film thickness is too thick, the developing speed is decreased, and the diffraction efficiency is reduced. Also, when the film thickness is too thin, sufficient diffraction efficiency is not obtained.

The silver/gelatin ratio of the silver halide emulsion layer in the present invention represents a weight ratio per the unit area of the silver (metal silver corresponding value) and gelatin contained in the silver halide emulsion layer.

As the silver halide emulsion layer of the present invention, various techniques and additive agents or the like known in the art can be used. A silver halide emulsion layer, a protection layer and a backing layer or the like are allowed to contain, for example, various kinds of chemical sensitizers, color tone agents, hardeners, surface-active agents, thickeners, plasticizers, lubricants, developing depressants, ultraviolet absorbents, irradiation inhibitor dyes, heavy metal atoms and mat agents or the like according to need by various kinds of methods. The silver halide emulsion layer of the present invention is allowed to contain polymeric latex.

More In particular, these additive agents are described in Research Disclosure, Volume 178, 7643 (December, 1978) and Volume 187, 8716 (November, 1979), and the applicable parts are summarized below.

| Kind of Additive Agents | RD7643 | RD8716 |
|---|---|---|
| 1. Chemical sensitizer | page 23 | right column on page 648 |
| 2. Sensitivity elevating agent | | same as above |
| 3. Spectroscopy sensitizer, hypersensitizer | pages 23 to 24 | right column on page 648 to right column in page 649 |
| 4. Brightening agent | page 24 | |
| 5. Fogging inhibitor, stabilizer | pages 24 to 25 | right column on page 649 |

-continued

| Kind of Additive Agents | RD7643 | RD8716 |
|---|---|---|
| 6. Optical absorbent, filter dye, ultraviolet absorbent | pages 25 to 26 | right column on page 649 to left column in page 650 |
| 7. Stain inhibitor | right column on page 25 | left to right columns on page 650 |
| 8. Pigment image stabilizer | page 25 | |
| 9. Hardener | page 26 | left column on page 651 |
| 10. Binder | page 26 | same as above |
| 11. Plasticizer, lubricant | page 27 | right column on page 650 |
| 12. Applying auxiliary agent, surface-active agent | pages 26 to 27 | same as above |
| 13. Static inhibitor | page 27 | same as above |

The present invention obtains a hologram by exposing, developing and bleaching using the hologram silver halide photographic material according to the present invention. It is preferable that the diffraction efficiency in exposing amounts of 100 $\mu Jcm^{-2}$ is 40% or more in this hologram.

The method for producing the hologram according to the present invention, wherein the hologram silver halide photographic material is exposed, and developed and bleached.

It is preferable that the developing is conducted by ascorbic acid, sodium carbonate and a developer containing phenidone, and high diffraction efficiency can be obtained in low exposing amounts. The developer containing the ascorbic acid, the sodium carbonate and the phenidone may be a commercial item, and may be prepared before use.

It is preferable that the bleaching is conducted by the bleach solution containing parabenzoquinone, citric acid and potassium bromide. Referring to the reflective hologram, the effect that a shift of the reproduction wavelength due to the exposing amounts is reduced by combining the bleaching with the processing procedure by the developer which contains the ascorbic acid, the sodium carbonate and the phenidone is exhibited. The bleach solution containing the parabenzoquinone, the citric acid and the potassium bromide may be a commercial item, and may be prepared before use.

It is preferable to conduct image exposure using a laser beam having a visible region wavelength in which the phase is generally equal as an exposure light source of the hologram silver halide photographic material of the present invention. In the image reproduction, the light of the wavelength of the laser beam forming an image plays the greatest role. From this perspective, a desirable reproduction image which does not absorb the wavelength of the laser beam forming an image is obtained in an on-exposure part of the photograph material after processing. As a laser beam of a visible region wavelength, for example, a Nd:YAG laser, a Kr laser, an Ar laser, a HeNe laser and a semiconductor laser or the like are used. A solid-state laser and SHG laser resonator described in Japanese Published Unexamined Patent Application No. 8-160479 can be used.

DETAILED DESCRIPTION OF PREFERRED EMBODIMENTS

Hereinafter, although the present invention will be specifically described with reference to Examples, embodiments of the present invention are not limited thereto.

Embodiment 1

(Production of Silver Halide Emulsion 1)

| | |
|---|---|
| Solution A | |
| Water | 25 L |
| Potassium bromide | 15 g |
| Gelatin | 2747 g |
| Solution B | |
| Water | 11 L |
| Iodination potassium | 69 g |
| Potassium bromide | 1260 g |
| Solution C | |
| Water | 11 L |
| Silver nitrate | 1800 g |

Solution B and solution C to which 350 ml of an aqueous ammonia of 3.1% was added were simultaneously added into solution A containing gelatin and potassium bromide which are held at 53° C. for 1 minute while solution A is stirred. After further stirring the resultant solution for 1 minute, 150 ml of a citric acid aqueous solution of 40.0% was added, and the resultant solution was cooled to 4° C. After a silver halide emulsion was set, the solution was washed by a noodle washing method to remove excessive salts contained in the aqueous solution. After the aqueous solution was then frozen to −40° C., the silver halide emulsion was condensed by washing the aqueous solution and by removing excessive moisture.

Thereby, produced was a silver halide emulsion 1 which contains spherical silver halide particles containing 96 mol % of silver iodide and 4 mol % of silver bromide and having an average particle diameter of 0.05 μm in the measurement of average particle diameters of 30 pieces in a transmission electron microscope observation.

(Production of Silver Halide Emulsion 2)

Produced was a silver halide emulsion 2 which contains spherical silver halide particles having an average particle diameter of 0.1 μm in the average particle diameter measurement in the same manner as in the production of the silver halide emulsion 1 except that the simultaneous addition time of the solution B and solution C to which an aqueous ammonia was added was changed to 2 minutes in the production of the silver halide emulsion 1.

(Aging of Each of Silver Halide Emulsions)

Each of the silver halide emulsions produced above was subjected to the following chemistry aging. That is, referring to each of the silver halide emulsions produced above, 28 mg of sodium subsulfite was added to the silver halide emulsion 1 per 1 mol of silver and 14 mg of sodium subsulfite was added to the silver halide emulsion 2 while holding the temperature at 59° C. Each of the silver halide emulsions was aged for 45 minutes, cooled to 42° C., and the aging of each of the silver halide emulsions was completed.

(Preparation of Silver Halide Emulsion Layer Liquid)

The following additive agents are added in the amount of addition per 1 mol of following silver or per unit area of the application to each of the silver halide emulsions 1 and 2 in which the aging was completed.

| | |
|---|---|
| Compound (indicated in Table 1 | 280 mg/1 mol of Ag |
| Compound A-1 | 140 mg/1 mol of Ag |

-continued

| | |
|---|---|
| Compound A-2 | 3.4 g/1 mol of Ag |
| Hardener H-1 | 36 mg/m$^2$ |
| Silane coupling agent H-2 | 230 mg/m$^2$ |

[Chemical Formula 9]

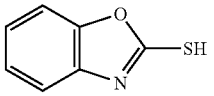

A-1

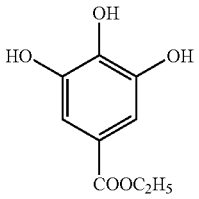

A-2

$C(CH_2SO_2CH{=}CH_2)_4 \cdot NH_2(CH_2)_2SO_3K$

H-1

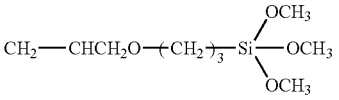

H-2

(Preparation of Backing Layer Liquid)

The backing layer liquid having the following composition was prepared.

| | |
|---|---|
| Compound E | 28 g |
| Compound (1) | 2.5 g |
| Compound (2) | 5.0 g |
| Compound (3) | 3.5 g |
| Methyl cellosolve | 28 ml |
| Ethanol | 450 ml |
| Methanol | 450 ml |

[Chemical Formula 10]

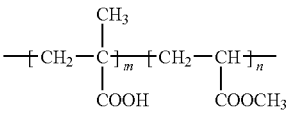

Compound E

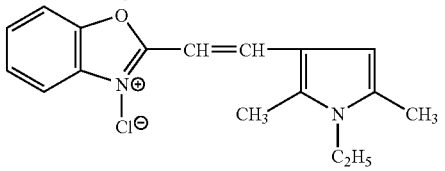

Compound (1)

-continued

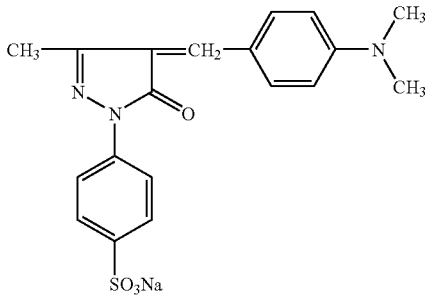

Compound (2)

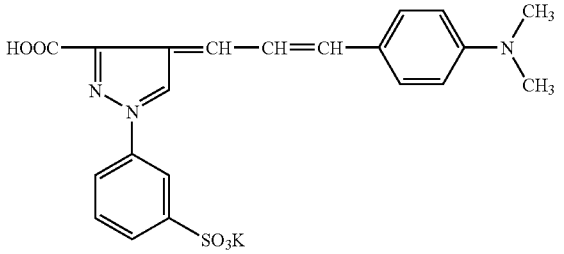

Compound (3)

(Production of Silver Halide Photographic Plate)

(1) Application of Backing Layer

When a backing layer is formed on the surface of a float glass support having a size of 17 inches×17 inches and a thickness of 2.3 mm which is subjected to fluoric acid processing, the backing solution described above was applied by a napkin coater so that the attached amount of a compound E is set to 300 mg/m$^2$ to provide the backing layer. When no backing layer is formed, only the fluoric acid processing was conducted.

(2) Coating of Silver Halide Emulsion Layer

When the backing layer of the glass support was formed, the silver halide emulsion layer was provided at the opposite side of the backing layer by a curtain coater, when no backing layer was formed, the silver halide emulsion layer liquid was applied on any surface to provide the silver halide emulsion layer, so that the film thickness of the silver halide emulsion layer liquid is described in Table 1.

Then, the seasoning was conducted in an environment of a temperature of 50° C. and relative humidity of 55% for 6 hours, and silver halide photographic plates 1 to 6 were respectively produced.

(Evaluation of Samples)

A reflective hologram was recorded on each of the obtained samples by using a He—Ne laser as a light source. The exposure intensity of the emulsion film surface at this time was set to 760 uWcm$^{-2}$. After processing at 20° C. for 2 minutes using the following developer and stop-processing for 30 seconds using acetic acid of 1.5%, bleach processing was conducted by the following bleach solution for 3 minutes, and washing was conducted for 15 minutes by flowing water. Then, natural drying was conducted to obtain a reflective hologram image. At this time, maximum diffraction efficiency (%), sensitivity (exposing energy amount; relative value), and the condition of stain (visual observation) of a transparent area were evaluated.

| (Developer Formulation) | |
|---|---|
| ascorbic acid, | 18 g |
| sodium carbonate, | 60 g |
| phenidone | 0.5 g |

The total amount was set to 1000 ml using pure water.

| (Bleach solution formulation) | |
|---|---|
| pure water, | 800 ml |
| citric acid, | 15 g |
| potassium bromide, | 50 g |
| p-benzoquinone, | 2 g |

The total amount was set to 1000 ml using pure water.

The above processes and results are shown in Table 1.

| Developer A (CW-C2) | |
|---|---|
| Catechol, | 10 g |
| L-ascorbic acid, | 5 g |
| Anhydrous sodium sulfite, | 5 g |
| Urea, | 50 g |
| Carbon dioxide sodium, | 30 g |

Pure water was added and the amount of the solution was set to 1000 ml.

| Developer B (PAAC) | |
|---|---|
| Ascorbic acid, | 18 g |
| Sodium carbonate, | 60 g |
| Phenidon. | 0.5 g |

TABLE 1

| No. | Silver halide emulsion | Compound D | Film thickness (μm) | Backing layer | Maximum diffraction efficiency (%) | Relative sensitivity | Stain (visual observa-tion) | Note |
|---|---|---|---|---|---|---|---|---|
| 1 | 2 | D-1 | 8.0 | none | 25 | 120 | x | Comparison |
| 2 | 1 | * comparison dye | 8.0 | none | 51 | 85 | xxx | Comparison |
| 3 | 1 | D-1 | 3.0 | none | 30 | 65 | ○ | Comparison |
| 4 | 1 | D-1 | 13.0 | none | 27 | 105 | x | Comparison |
| 5 | 1 | D-1 | 8.0 | none | 56 | 100 | ◎ | Present invention |
| 6 | 1 | D-1 | 8.0 | Existence | 58 | 92 | ○ | Present invention |

Relative sensitivity: Sample No. 5 is defined as 100.

[Chemical Formula 11]

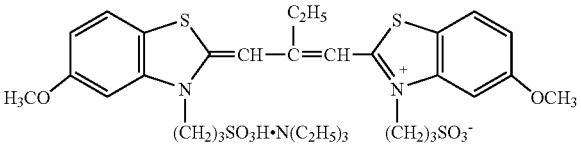

Comparison Dye

As is apparent from Table 1, the sample of the present invention has high diffraction efficiency, the sensitivity is high and stain visual check results are satisfactory.

2. Evaluation of Transmission Type Hologram

The He—Ne laser was used as the light source, and the hologram was recorded on the silver halide photographic plate [equivalent to sample No. 5 (hereinafter, referred to as "P7000" including the drawings)] obtained above by the following optical arrangement. The exposure intensity of the emulsion surface at this time was set to 580 $uWcm^{-2}$. The developing was conducted at 20° C. for 2 minutes by three kinds (developers A, B, C) of formulations shown below, and the stopping was conducted in the acetic acid solution of 1.5% for about 30 seconds.

Pure water was added and the amount of the solution was set to 1000 ml. The bleaching was conducted after the developing and the stopping processes. The bleaching was conducted, in two kinds of formulations of a bleach solution a (PBQ-2) and a bleach solution b (iron-EDTA) for the period of time for which a melanism part is sufficiently processed. The treating temperature was 20° C.

| Bleach solution a | |
|---|---|
| Parabenzoquinone | 2 g |
| Citric acid | 15 g |
| Potassium bromide | 50 g |

Pure water was added and the amount of the solution was set to 1000 ml.

| Bleach solution b (iron-EDTA) | |
|---|---|
| Iron EDTA | 30 g |
| Potassium bromide | 30 g |

Pure water was added and the amount of the solution was set to 1000 ml.

After the bleaching, washing was sufficiently conducted, and hydro-extraction processing was conducted for 30 seconds by dry well manufactured by Fuji Photo Film Co., Ltd. Then, air-drying was conducted at room temperature for 1 hour.

The obtained hologram was reproduced by the laser beam used for exposure for evaluation.

Figure 2:
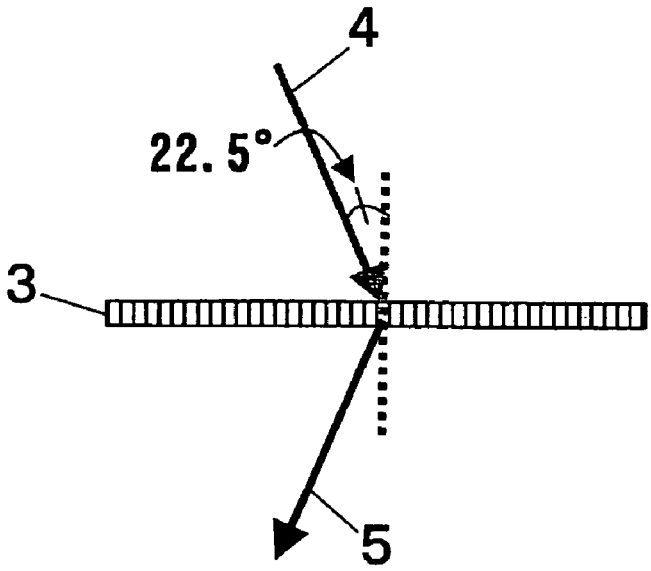
FIG. 2 is an explanatory drawing of reproduction method in the transmission type hologram.

As shown in FIG. 1, recording was conducted by incidence of two luminous fluxes 1 and 2 (incidence angle of 22.5 degrees) to the silver halide photographic plate (silver salt) 3. And, as shown in FIG. 2, reproducing was conducted by reproduction illumination light 4 of 22.5 degrees to the silver halide photographic plate (silver salt) 3 to obtain diffraction light 5 of 22.5 degrees.

The diffraction efficiency of the hologram produced by changing the developing and bleaching processings is shown below in FIG. 3.

Figure 3:
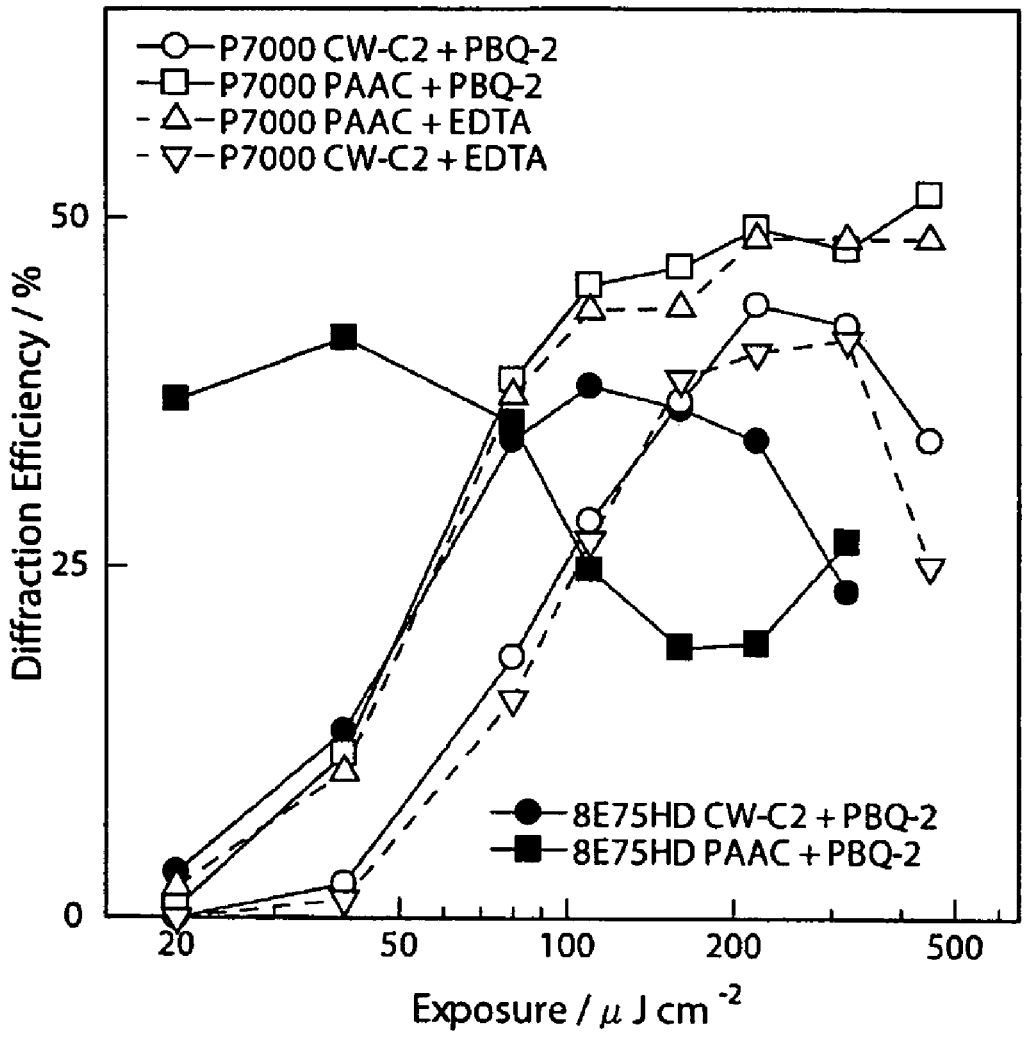
FIG. 3 is a graph showing the diffraction efficiency of a hologram.

As is apparent from FIG. 3, compared with the developer CW-C2, the diffraction efficiency was obtained in the lower exposing amounts by PAAC developing. The bleaching was also the same in any formulation.

As described above, it was found that a hologram having high efficient and diffraction efficiency can be produced by developing in PAAC in the case of the transmission type hologram.

(Evaluation of Reflection Type Hologram)

Figure 4:
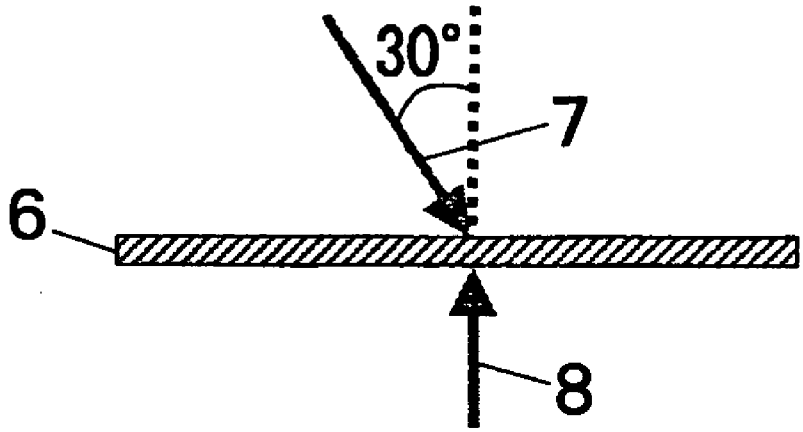
FIG. 4 is an explanatory drawing of recording method in the reflection type hologram.
Figure 5:
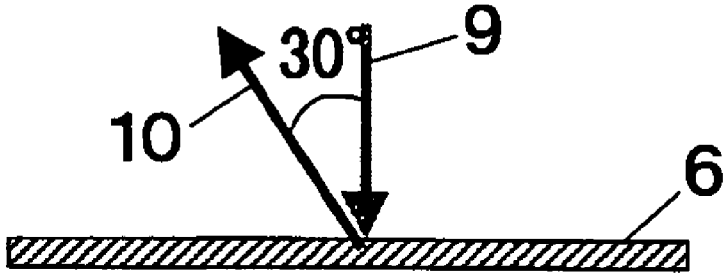
FIG. 5 is an explanatory drawing of reproduction method in the reflection type hologram.

The evaluation of the reflection type hologram was the same as that of the transmission type hologram except that the hologram was recorded and reproduced in the optical arrangement shown in FIGS. 4, 5. The developing and the bleaching were also conducted and evaluated under the same condition as those of the transmission type hologram.

That is, as shown in FIG. 4, the evaluation was conducted by incidence of two luminous fluxes 7 and 8 (right angle to an incidence angle of 30 degrees) to the silver halide photographic plate (silver salt) 6. The reproduction was conducted, as shown in FIG. 5, wherein the reproduction illumination light 9 was set to a right angle to the silver halide photographic plate (silver salt) 6 to obtain diffraction light 10 of 30 degrees.

The reflective hologram was evaluated by measuring the reflection spectrum by an ultraviolet visual spectrophotometer (U-3210, manufactured by Hitachi, Ltd.). The results are shown in FIG. 6.

Figure 6:
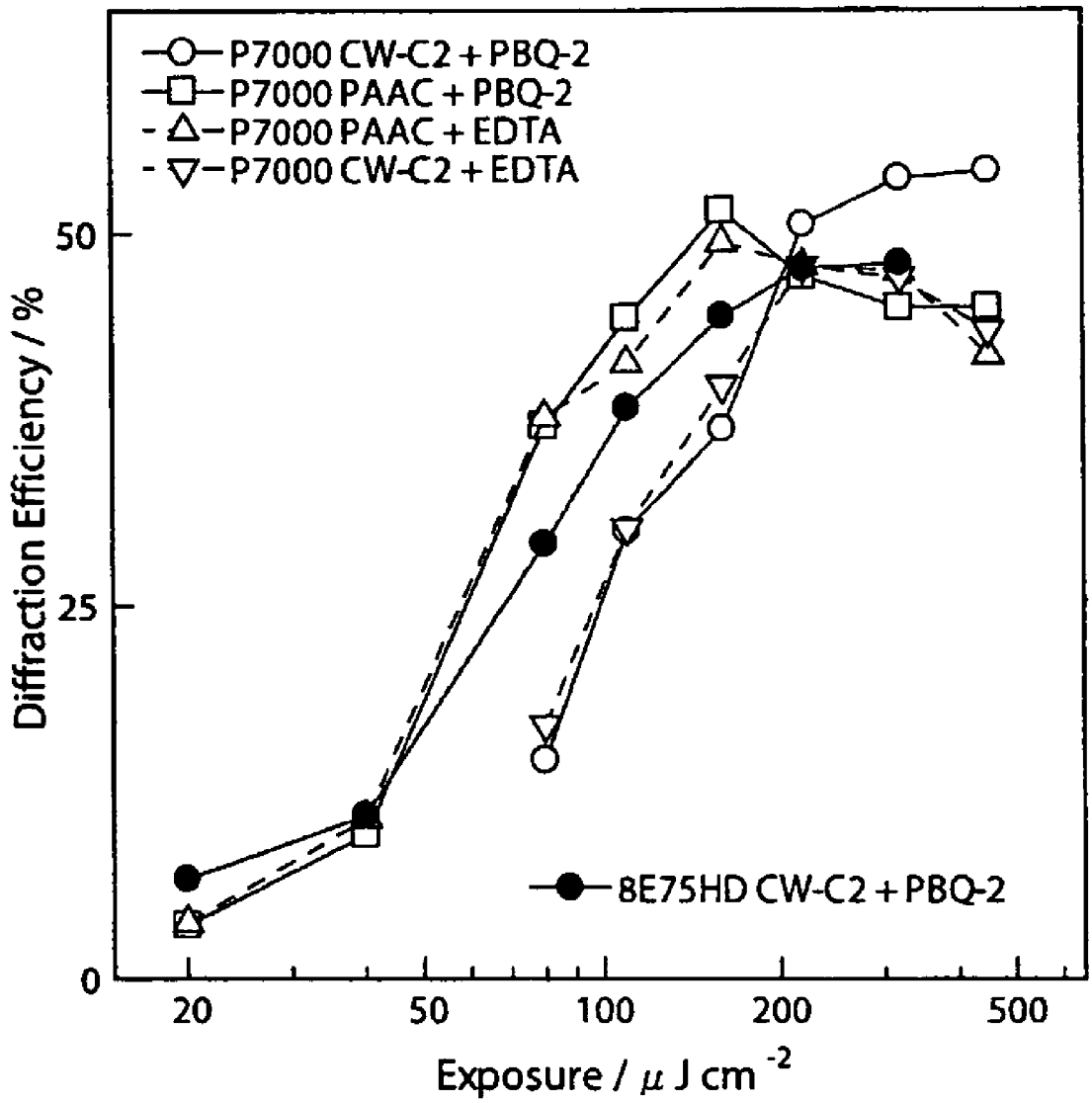
FIG. 6 is a graph showing the diffraction efficiency of a hologram.

As is apparent from FIG. 6, high diffraction efficiency can be obtained in lower exposing amounts by developing in PAAC as compared with developing in CW-C2 also in the reflective hologram.

Also, the following evaluation for the obtained hologram was also conducted.

Figure 7:
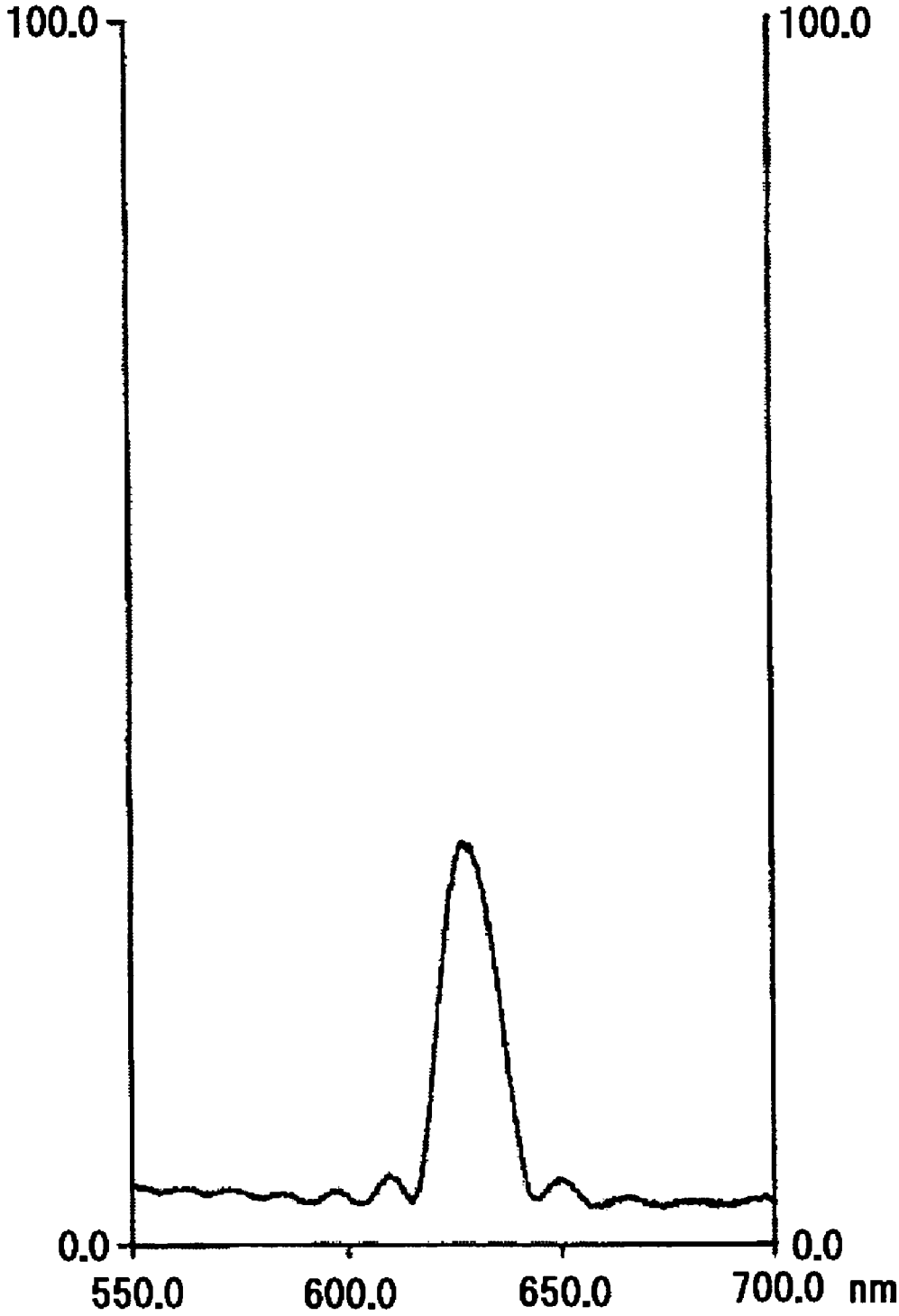
FIG. 7 is a graph showing a reflectance to a reproduction wavelength.

The reproduction wavelength of the hologram is determined by wavelength selectivity. FIG. 7 shows results obtained by measuring reflectance of the silver halide photographic plate (silver salt) obtained above to the reproduction wavelength using U-3210 (manufactured by Hitachi, Ltd.).

FIG. 7 shows that the peak of reflectance is near 620 nm and wavelength selectivity is shown near the wavelength. This value can be a wavelength having the highest sensitivity.

Figure 8:
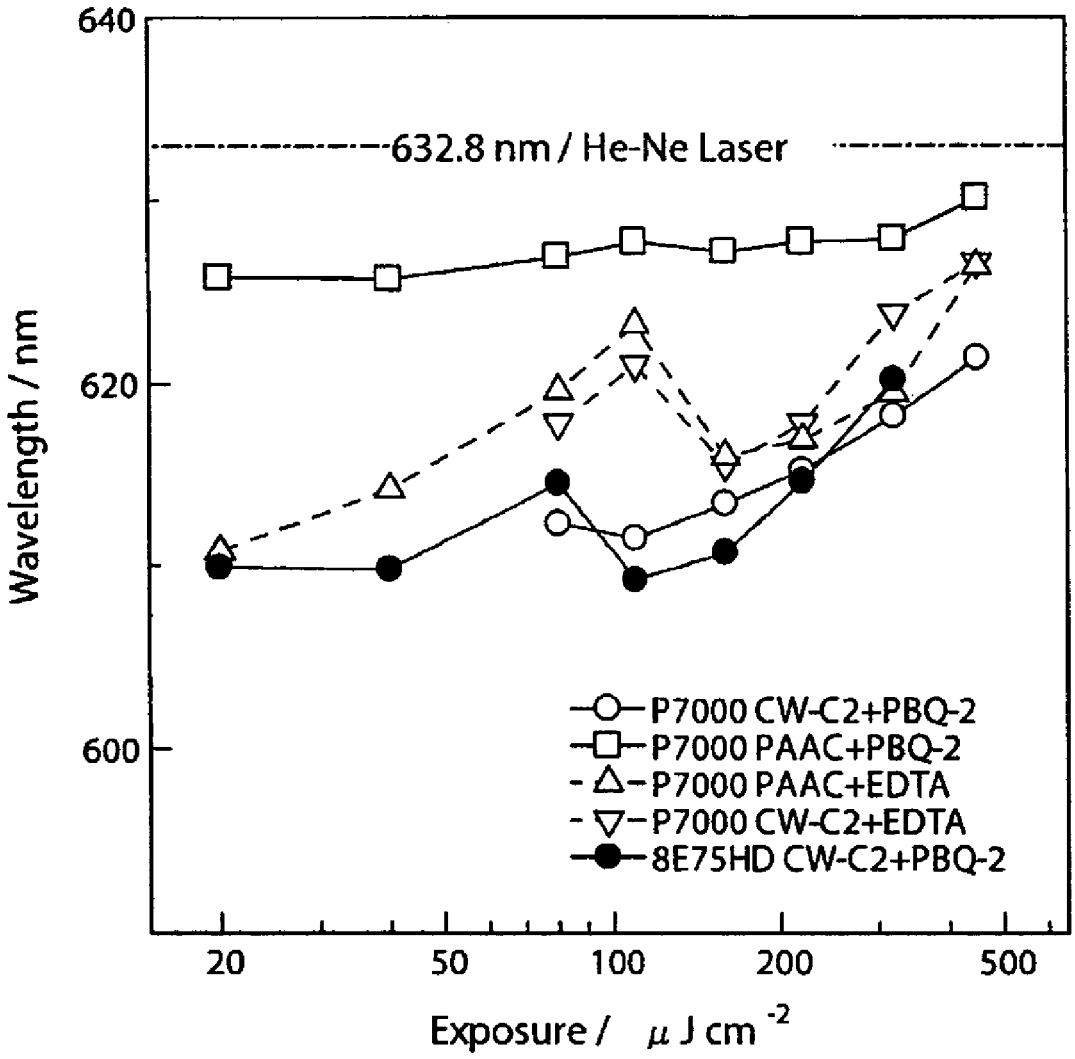
FIG. 8 is a graph showing wavelength dependability due to exposing amounts for a silver salt (silver halide photographic plate).

FIG. 8 shows results obtained by measuring a peak wavelength to the exposing amounts to the silver halide photographic plate (silver salt) and by plotting the measured data, and shows the wavelength dependability of exposing amounts.

As is apparent from FIG. 8, the variation in the reproduction wavelengths is not observed in most of the ones obtained developing in PAAC and bleaching in PBQ-2. By contrast, in ones in which the combination of the developing and bleaching is based on other formulation, the variation in the reproduction wavelengths was observed.

As a result, the solution obtained by developing in PAAC and bleaching in PBQ-2 had less variation in the wavelength dependability by the exposing amounts.

The present invention can provide a hologram silver halide photographic material having high diffraction efficiency, providing an excellent image and having less color residue and noise in a transparent part, a hologram, and a method for producing the same.

What is claimed is:

1. A method for producing a hologram comprising the steps of exposing, developing and bleaching a hologram silver halide photographic material having at least one silver halide emulsion layer formed on a support, wherein the hologram silver halide photographic material contains silver halide particles having an average particle diameter of 0.03 μm to 0.05 μm; a film thickness of the silver halide emulsion layer is 4 μm to 9 μm; a silver/gelatin ratio of the silver halide emulsion layer is 0.3 to 0.6; and the silver halide emulsion layer contains at least one kind of compounds represented by the following general formula, and where the photographic material is developed by contacting with ascorbic acid, sodium carbonate and a developer containing phenidone;

general formula

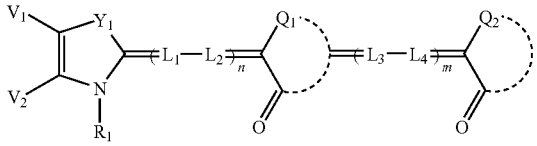

$(M_1)_{m1}$ wherein $Y_1$ represents a —N(R)— group, an oxygen atom, a sulfur atom, or a selenium atom; R represents an aliphatic group having carbon atoms of 10 or less; $R_1$ represents an aliphatic group, aryl group or heterocyclic group which contains at least one water-soluble group as a substituted group; $V_1$ and $V_2$ respectively represent a hydrogen atom, an alkyl group, an alkoxy group, an aryl group, or a substituted or non-substituted group forming a condensed ring with an azole ring by the bonding of $V_1$ and $V_2$; n represents 1 or 2 and m represents 0 or 1; $L_1$, $L_2$, $L_3$ and $L_4$ respectively represent a methine group; at least one of $L_1$ and $L_2$ has a substituted group having 3 or more carbon atoms and having an SP less than 539 when n is 1 or 2 and m is 0; and at least one of $L_1$, $L_2$, $L_3$ and $L_4$ has a substituted group having 3 or more carbon atoms and SP is less than 539 when n is 1 or 2 and m is 1; herein, SP is a value represented by SP=3.563L−2.661B+535.4; L represents a Sterimol parameter (Å); and B represents a value (Å) of the smaller one of the sum $B_1+B_4$ and sum $B_2+B_3$ of the Sterimol parameter; $Q_1$ and $Q_2$ respectively represent a nonmetallic atom group required for forming an acid ring; $M_1$ represents an ion required for cancelling all the electric charges of a molecule, and $n_1$ represents the number required for neutralizing the electric charges of the molecule; $n_1$ is 3 or more.

2. The method for producing the hologram of claim 1, wherein the bleaching process step is by contacting the hologram silver halide photographic material with a bleach solution containing parabenzoquinone, citric acid and potassium bromide.

3. The method for producing the hologram of claim 1, wherein the hologram has the diffraction efficiency in exposing amounts of 100 $\mu Jcm^{-2}$ is 40% or more.

4. The method for producing the hologram of claim 1, wherein the substituted groups have 3 or more carbon atoms and being SP<539 are selected from the group consisting of a substituted or unsubstituted branched alkyl group having 3 or more carbon atoms, benzyl group, phenethyl group, and alkoxy carbonyl group having 4 or more carbon atoms.

5. The method for producing the hologram of claim 1, wherein the substituted groups have 3 or more carbon atoms and where SP<539 are selected from the group consisting of a substituted or unsubstituted isopropyl group, branched butyl group, branched pentyl group, branched hexyl group, branched octyl group, benzyl group, phenethyl group, t-butyloxycarbonyl group, cyclopentyl group and cyclopropyl group.

6. The method for producing the hologram of claim 2, wherein the substituted groups have 3 or more carbon atoms and being SP<539 are selected from the group consisting of a substituted or unsubstituted branched alkyl group having 3 or more carbon atoms, benzyl group, phenethyl group, and alkoxy carbonyl group having 4 or more carbon atoms.

7. The method for producing the hologram of claim 2, wherein the substituted groups have 3 or more carbon atoms and where SP<539 are selected from the group consisting of a substituted or unsubstituted isopropyl group, branched butyl group, branched pentyl group, branched hexyl group, branched octyl group, benzyl group, phenethyl group, t-butyloxycarbonyl group, cyclopentyl group and cyclopropyl group.

8. The method of claim 1, wherein the silver halide emulsion further contains gelatin.

9. The method of claim 1, wherein said step of exposing comprises exposing the hologram silver halide photographic material to an image using a light source.

10. The method of claim 9, wherein the light source is a laser beam in a visible wavelength.

11. The method of claim 1, wherein the developing step comprises contacting the hologram silver halide photographic material with a developing agent.

12. A method for producing a hologram comprising the steps of:

exposing a silver halide photographic material having at least one silver halide emulsion layer formed on a support to a light source to form an image;

developing the photographic material with a developing agent containing a mixture of ascorbic acid, sodium carbonate and phenidone; and bleaching the photographic material with a bleach solution containing a mixture of parabenzoquinone, citric acid and potassium bromide, the photographic material containing gelatin and silver halide particles having an average particle diameter of 0.03 μm to 0.06 μm; the silver halide emulsion layer having a film thickness of 4 μm to 9 μm and a silver/gelatin ratio of 0.3 to 0.6, the silver halide emulsion layer containing at least one kind of compounds represented by the following general formula, general formula

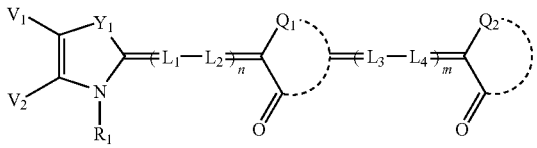

$(M_1)_{m1}$ wherein $Y_1$ represents a —N(R)— group, an oxygen atom, a sulfur atom, or a selenium atom; R represents an aliphatic group having 10 or fewer carbon atoms; $R_1$ represents an aliphatic group, aryl group or heterocyclic group which contains at least one water-soluble group as a substituted group; $V_1$ and $V_2$ respectively represent a hydrogen atom, an alkyl group, an alkoxy group, an aryl group, or a substituted or non-substituted group forming a condensed ring with an azole ring by the bonding of $V_1$ and $V_2$; n represents 1 or 2 and m represents 0 or 1; $L_1$, $L_2$, $L_3$ and $L_4$ respectively represent a methine group; at least one of $L_1$ and $L_2$ has a substituted group having 3 or more carbon atoms and having an SP less than 539 when n is 1 or 2 and m is 0; and at least one of $L_1$, $L_2$, $L_3$ and $L_4$ has a substituted group having 3 or more carbon atoms and SP is less than 539 when n is 1 or 2 and m is 1; herein, SP is a value represented by SP=3.563L−2.661B+535.4; L represents a Sterimol parameter (Å); and B represents a value (Å) of the smaller one of the sum $B_1+B_4$ and sum $B_2+B_3$ of the Sterimol parameter; $Q_1$ and $Q_2$ respectively represent a nonmetallic atom group required for forming an acid ring; $M_1$ represents an ion required for cancelling all the electric charges of a molecule, and $n_1$ represents the number required for neutralizing the electric charges of the molecule; $n_1$ is 3 or more.

* * * * *